US005379920A

United States Patent [19]

Lisak

[11] Patent Number: 5,379,920

[45] Date of Patent: Jan. 10, 1995

[54] LIQUID CONTAINMENT SYSTEM

[75] Inventor: Stephen P. Lisak, Arab, Ala.

[73] Assignees: Ryder International Corporation, Arab, Ala.; American Sterilizer Company, Erie, Pa.

[21] Appl. No.: 96,466

[22] Filed: Jul. 23, 1993

[51] Int. Cl.[6] ..... B67D 5/56

[52] U.S. Cl. ..... 222/129; 222/147; 222/189; 206/222

[58] Field of Search ..... 222/83, 129, 145, 189, 222/541, 130, 147, 478, 464, 482; 215/263; 206/222

[56] References Cited

U.S. PATENT DOCUMENTS 4,757,916 7/1988 Goncalves ..... 222/83

5,275,310 1/1994 Mielnik et al. .

*Primary Examiner*—Gregory L. Huson

*Attorney, Agent, or Firm*—Trexler, Bushnell, Giangiorgi & Blackstone, Ltd.

[57] ABSTRACT

A container for storing and dispensing liquid includes a housing having a primary fluid storage cavity for a first liquid, for example, concentrated hydrogen peroxide, and a separate reservoir chamber within the housing so that a second diluent liquid within the reservoir chamber is normally isolated from the primary liquid and storage cavity. An internally movable member within the housing cooperates with the reservoir chamber to form a detent structure which provides selective interference reinforcement to ensure the integrity of sealing between the reservoir chamber and the cavity. The movable member is selectively displaced to relieve the interference reinforcement and sealing and to create a pathway for flow communication from the chamber into the cavity enabling an inter-mixture of the second diluent fluid and the primary fluid. For example, a diluent such as water can be stored and selectively dilute the residue of a primary hydrogen peroxide solution sufficiently to a reduced concentration which will be non-hazardous in subsequent general refuse disposal. In the illustrated embodiment, the reservoir chamber is formed within a cap structure on the housing in which a metallic foil wall forms the upper wall of both the reservoir chamber and the cap. A tubular conduit extends from and selectively moves with respect to the cap. The detent structure includes a catch structure peripherally formed on the tubular conduit and a seat structure engaged by the catch structure is formed on the reservoir chamber so that selective movement of the tubular conduit relieves the interference reinforcement and sealing by the detent structure when the primary and second fluids are intermixed.

12 Claims, 6 Drawing Sheets

LIQUID CONTAINMENT SYSTEM

BACKGROUND OF THE INVENTION

The present invention relates to liquid containers and more particularly to containers for separate storage of multiple liquids within the container.

Numerous systems require the use of liquid supply containers which are constructed to prevent refilling, often because the character of the liquid is either considered hazardous or the liquid must be of unquestioned purity. For example, U.S. Pat. No. 4,941,519 describes a non-reusable container and the liquid feed system which aspirates the stored liquid from the non-reusable container. The liquid feed system includes a liquid transfer structure employing a cam which can be operated to disable fluid communication to or from the container to prevent reuse. Another vented container and liquid feed system is described in U.S. Pat. No. 5,037,623. Nevertheless, residual liquid within such exhausted containers might remain hazardous in handling and disposal. This disadvantage is eliminated by liquid containers in accordance with the present invention.

SUMMARY OF THE INVENTION

In accordance with the present invention, a container for storing and dispensing liquid includes a housing having a primary fluid storage cavity for a first liquid, for example, concentrated hydrogen peroxide, and a separate reservoir chamber within the housing so that a second diluent liquid within the reservoir chamber is normally isolated from the primary liquid and storage cavity. An internally movable member within the housing cooperates with the reservoir chamber to form a detent structure which provides selective interference reinforcement to ensure the integrity of sealing between the reservoir chamber and the cavity. The movable member is selectively displaced to relieve the interference reinforcement and sealing and to create a pathway for flow communication from the chamber into the cavity enabling an inter-mixture of the second diluent fluid and the primary fluid. For example, a diluent such as water can be stored and selectively dilute the residue of a primary hydrogen peroxide solution sufficiently to a reduced concentration which will be non-hazardous in subsequent general refuse disposal.

In the illustrated embodiment, the reservoir chamber is formed within a cap structure on the housing in which a metallic foil wall forms the upper wall of both the reservoir chamber and the cap. A tubular conduit extends from and selectively moves with respect to the cap. The detent structure includes a catch structure peripherally formed on the tubular conduit and a seat structure engaged by the catch structure is formed on the reservoir chamber so that selective movement of the tubular conduit relieves the interference reinforcement and sealing by the detent structure when the primary and second fluids are intermixed.

DETAILED DESCRIPTION OF THE ILLUSTRATED EMBODIMENT

Figure 1:
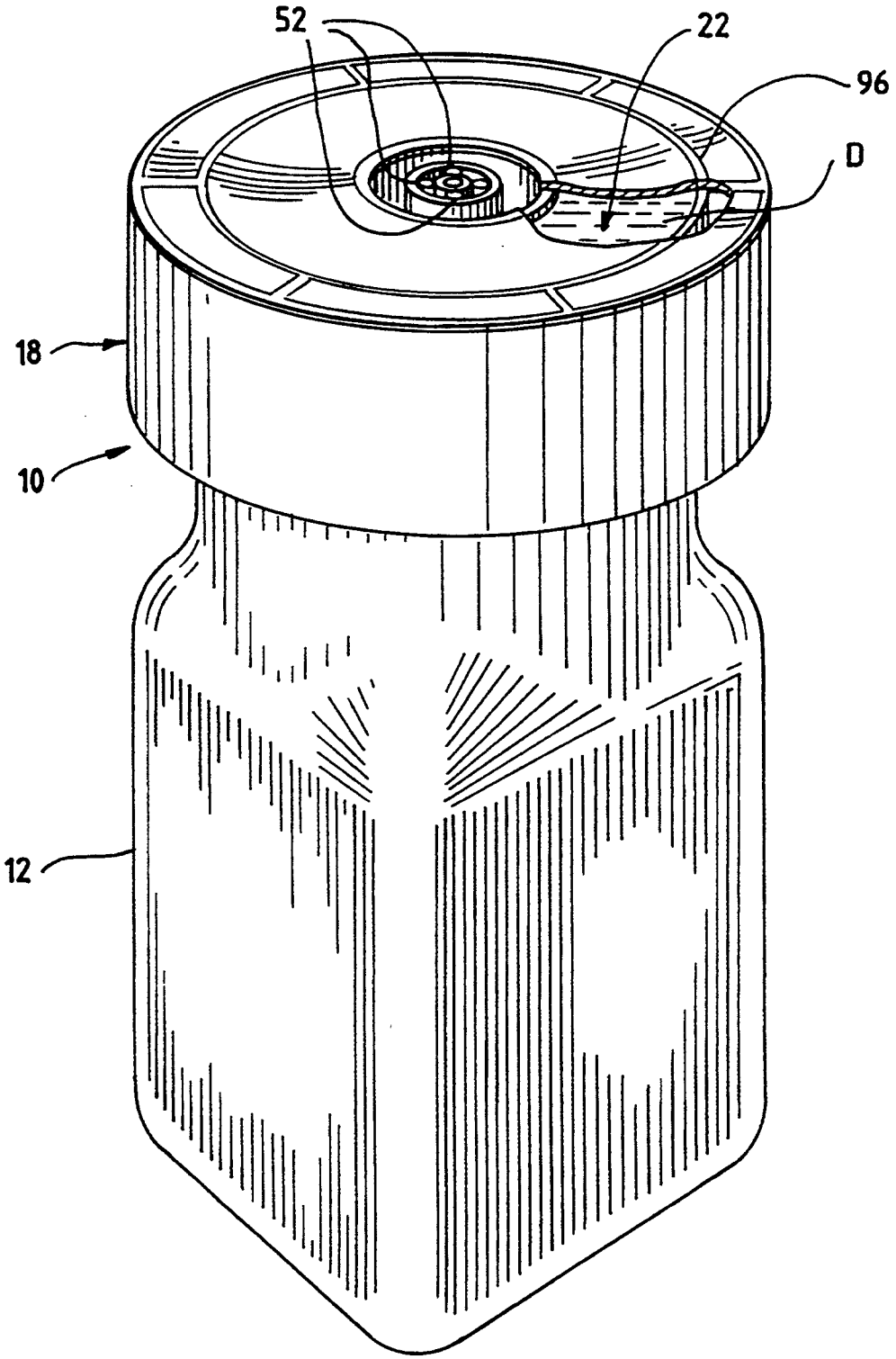
FIG. 1 is a perspective view of a preferred embodiment of a liquid container in accordance with the present invention, partially broken away to show a diluent reservoir within a cap structure on the container.
Figure 7:
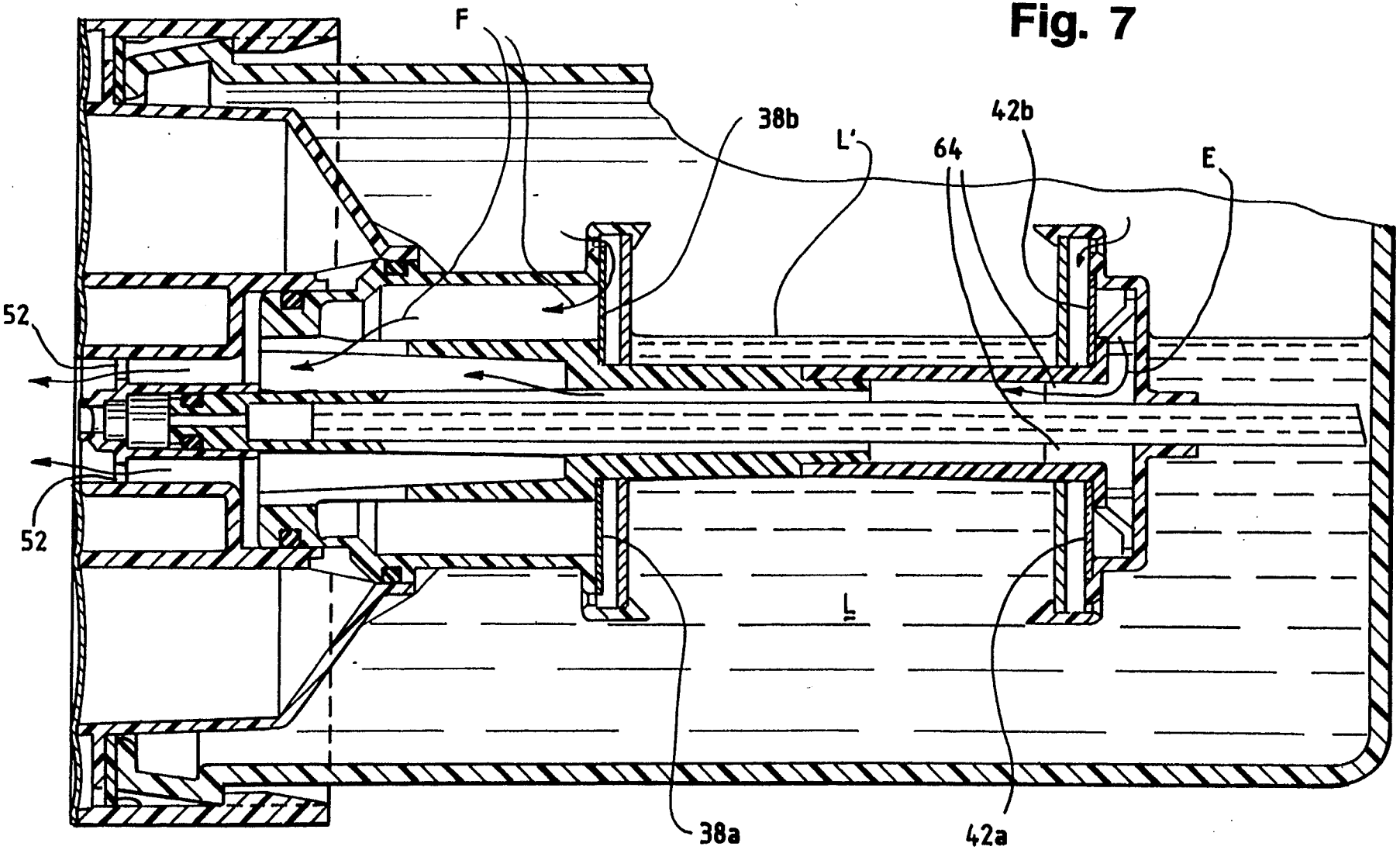
FIG. 7 is a sectional view similar to FIG. 2 showing the container in a generally horizontal orientation.

Referring to FIGS. 1 and 7, a fluid storage container in accordance with the present invention is generally designated by reference character 10. The container 10 has a housing which includes a side wall 12 and an interior cavity 14 for storage of a predetermined volume of liquid L, for example, concentrated hydrogen peroxide. The side wall 12 has an opening mouth 16 which is closed by a cap structure generally designated by reference character 18. A coaxial vent tube/dip tube assembly generally designated by reference character 20 serves to vent gases from the cavity 14 and centrally withdraw dispensed liquid L.

The illustrated container embodiment 10 according to the present invention is primarily designed for use in connection with a liquid feed system of the type described in the aforementioned U.S. Pat. No. 4,941,519, the disclosure of which is incorporated herein by reference. As described in this patent, the liquid feed system has a housing which includes a top portion in which a cam member (shown at I in FIG. 6 of the present application) is positioned, and a midportion in which a connection member is positioned, and a bottom portion having an opening which can receive a vented container 10 in the illustrated embodiment. The cam member moves a hollow needle (N, FIG. 3) carried by the connection member into a first position for sealed communication with the vent tube/dip tube assembly 20 to aspirate liquid L from the container 10 into an inlet port of the aforementioned liquid feed system. The cam member thereafter assumes a second position wherein the vent tube/dip tube 20 is operatively disabled, and simultaneously, causes release of a diluent D stored in a reservoir chamber 22 integrally formed in the cap assembly 18 as more fully described hereinafter. The diluent D released into intermixture with the liquid L results in a harmless intermixture so that the spent container may be disposed of with non-hazardous residual fluid content. The cam thereafter moves into a third position which allows the vented container 10 to be removed and replaced with another container 10 having fresh supply of liquid, as more fully described in the aforementioned U.S. Pat. No. 4,941,519.

Referring again to FIGS. 2 and 3, the vent tube/dip tube assembly 20 is assembled from an inner dip tube 24 which is coaxially supported within an upper vent tube portion 26 and lower vent tube portion 28 which are coupled at a mortise 30 and tenon 32 joint in the illustrated embodiment. The dip tube 24 preferably extends from the end of the lower vent portion 28 and provides a suction conduit to enable withdrawal of liquid therethrough when an aspiration needle N is inserted into the top of the dip tube 24 to transfer the liquid to the aforementioned liquid feed system.

Figure 3:
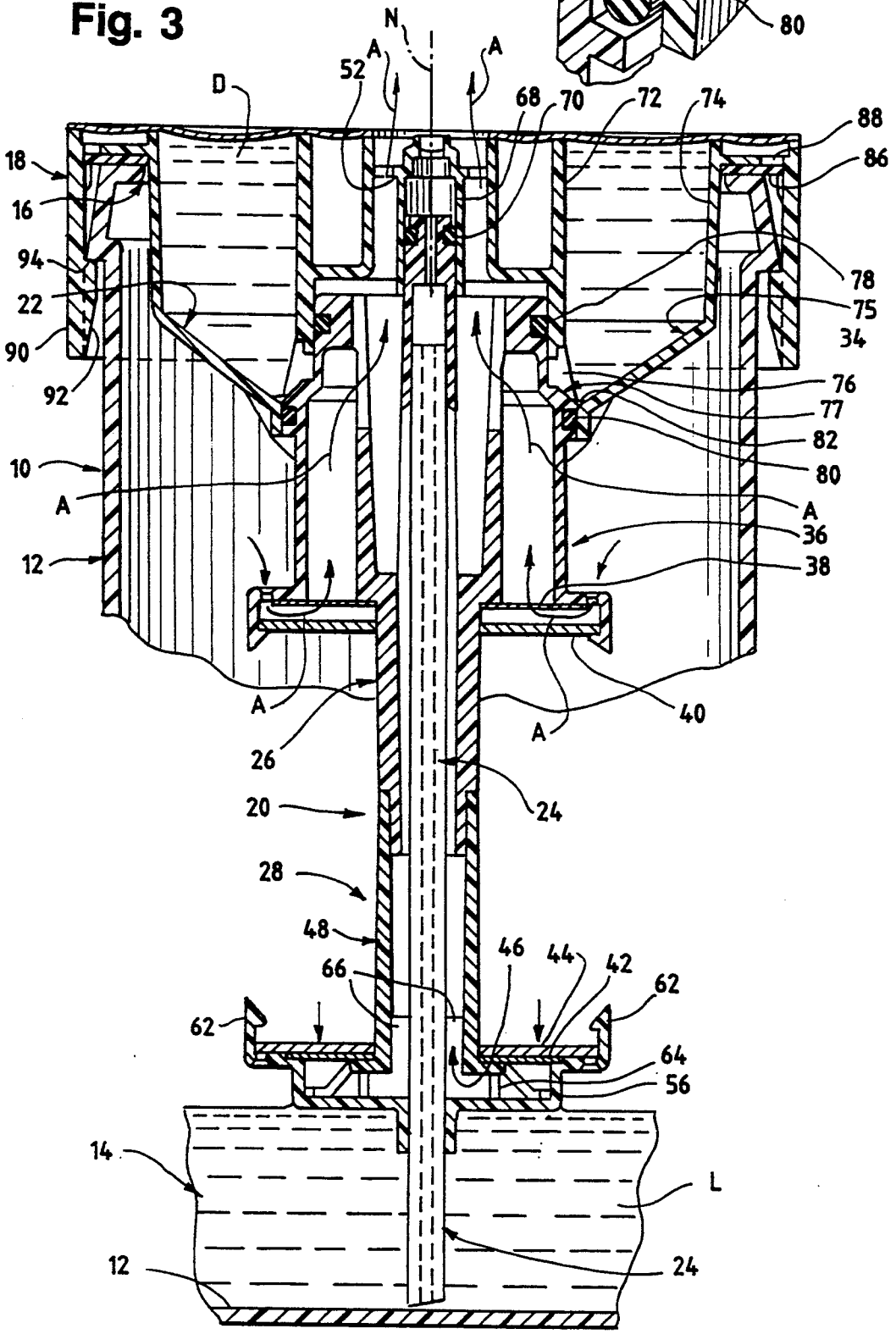
FIG. 3 is a vertical sectional view along a central plane through the container in FIG. 1.

The upper vent tube portion 26 includes an inner dip tube support cylinder 34 surrounded by an annular, upper vent conduit generally designated by reference character 36. The vent conduit 36 enables venting of vapors along a path indicated by arrows A which extends through the cap 18 as best shown in FIG. 3 and more fully described hereinafter. Vapors enter the conduit 36 through an annular, hydrophobic filter element 38 which will not pass the liquid D. A moveable washer 40 forms a protective valve element which is displaced by gravity from the filter 38 in the normal upright orientation of the container 10 as shown in FIG. 3. If the container becomes inverted through handling or accident, as shown in FIG. 5, the washer 40 will seal against the filter 38 preventing both entry of vapor as well as any hydraulic pressure which could otherwise cause puncture of the filter 38 leaking from the container.

Figure 5:
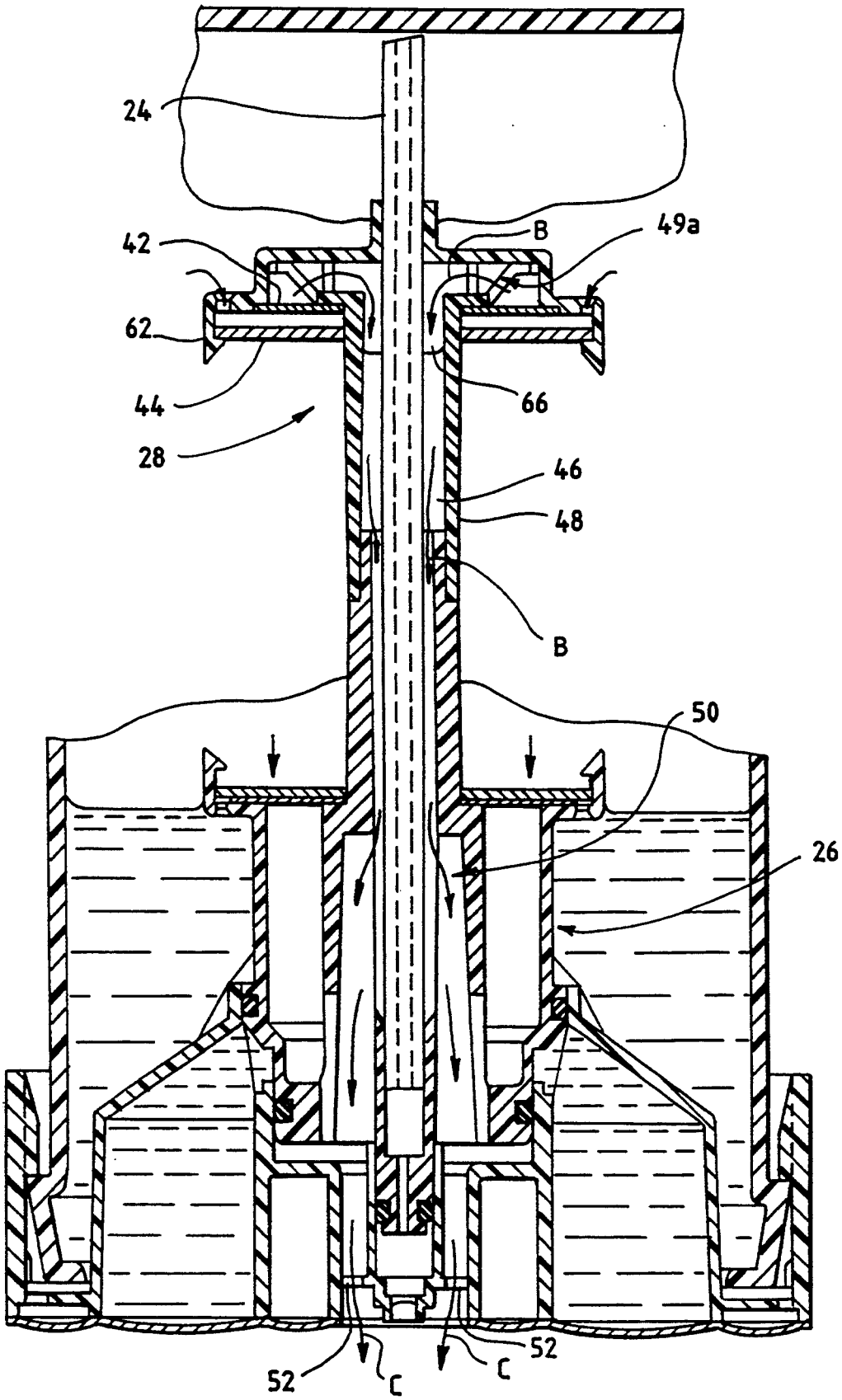
FIG. 5 is a sectional view similar to FIG. 3 in which the container has been inverted.

The lower vent portion 28 also has a second hydrophobic filter 42 and a similar valve washer 44 which would normally be closed in the upright orientation of a container of FIG. 3 but would be open to entry of vapor for venting in the inverted position of FIG. 5; the entering vapor can vent downwardly along the flow path indicated by arrows B through the annular conduit 46 formed between the dip tube 24 and the outer cylindrical wall 48 of the lower vent portion 28 which leads to the annular vent conduit 50 within the upper vent 26. The vapors discharge as indicated by arrows C downwardly through ports 52 formed in the cap structure 18 which is inverted in FIG. 5.

Referring now to FIG. 7, if the container 10 becomes horizontally oriented, the liquid will cover the lower oriented filter portions 38*a* and 42*a* however the upper oriented filter portions will lie above the liquid level L' to enable entry for venting vapor along respective pathways B and F as indicated in FIG. 7 leading to the cap discharge ports 52. As indicated in the horizontal orientation of the container 10 in FIG. 7, the valve washers 40 and 44 do not seal against the hydrophobic filters 38*a*,38*b* and 40*a*,40*b* since gravitational forces are directed on the washers 40 and 44 in parallel to the plane of the filters.

Referring again to FIG. 2, in the illustrated embodiment of the lower vent portion 28 the outer cylindrical wall is integrally molded with an end flange 49 which has an annular pattern of vent apertures 49*a* which provide vent passageway from the filter 42 into the annular conduit 46 as illustrated in FIG. 5. The vent flange 49 is secured within a recess 54 of a support base 56 guided by joining pins 58 which are received within notches formed in the apertures 49*a*. The support base 56 also provides a seat 60 for the annular filter 42 as well as a pair of retainer hooks 62 which limit displacement of the valve washer 44 as best shown in FIGS. 3 and 5. The support base 56 also has an interior, partitioned annular spacer wall 64 which axially spaces the end of the cylindrical vent wall 48 from the bottom of the recess 54 to provide clearance passageway for venting into the end of the conduit 46. The support base 56 also has axially projecting and spaced support guides 66 through which the dip tube 24 is supported.

Referring again to FIGS. 2 and 3, the cap structure 18 is molded to include a central bore 68 against which is sealed an O-ring 70 carried on the reduced diameter end portion of the inner dip tube support cylinder 34 of the over vent tube portion 26 which is inserted into the bore 68 when the dip tube/vent tube assembly 20 is joined to the cap structure 18. The cap structure 18 is also molded to include the diluent reservoir chamber 22 defined between the annular inner reservoir wall 72 and outer reservoir wall 74. An annular pattern of spaced ribs 76 join the bottom of the inner reservoir wall 72 to the to bottom of the outer reservoir wall 74 and thus define reservoir opening between the rib 76; the outer cylindrical wall of the upper vent conduit 36 serves a closure for the openings 77 between the rib 76 and this closure is normally sealed by an upper O-ring 78 which seals against the inner surface of the reservoir wall 72 and a lower 0 ring 80 which seals against the inner surface of the bottom reservoir wall 75.

Figure 4:
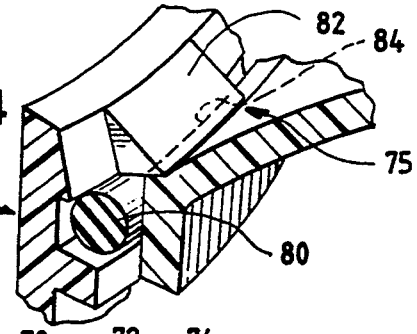
FIG. 4 is an enlarged, fragmentary view of the sealing joint on the diluent reservoir shown in FIG. 3.

When the dip tube/vent tube assembly 20 is assembled with cap structure 18, an annular pattern of angled snap hooks 82 radially projecting from the peripheral surface of the vent conduit 36, just above the lower O-ring seal 80 as shown in FIG. 3 and 4, provide an interference, snap-fit catch against an interior, annular ledge or shoulder 84 which is formed on the bottom reservoir wall 75 of the cap structure 18. The interference, snap-fit of each hook 82 against the seat 84 reinforces the seal by the O-ring 80 so that diluent D does not leak from the reservoir chamber 22, as well as serving as a releasable, retaining detent maintaining the normal securement of the upper vent portion 26 and vent tube-dip tube generally against the cap structure 18. The hook dimension and interference can be designed to control the force required for disengagement as explained hereinafter.

The upper end of the container side wall 12 adjacent mouth 16 seats an annular gasket 86 which seals against the annular interior surface of the cap rim 88. A depending skirt 90 from the cap 18 has an annular series of interiorally projecting lunges 92 which provide an interference snap fit against an outer collar 94 formed adjacent the top of the container wall 12 to provide snap-on assembly of the cap 18 to prevent both tampering and refilling of the container 10 (as best shown in FIG. 3).

Figure 2:
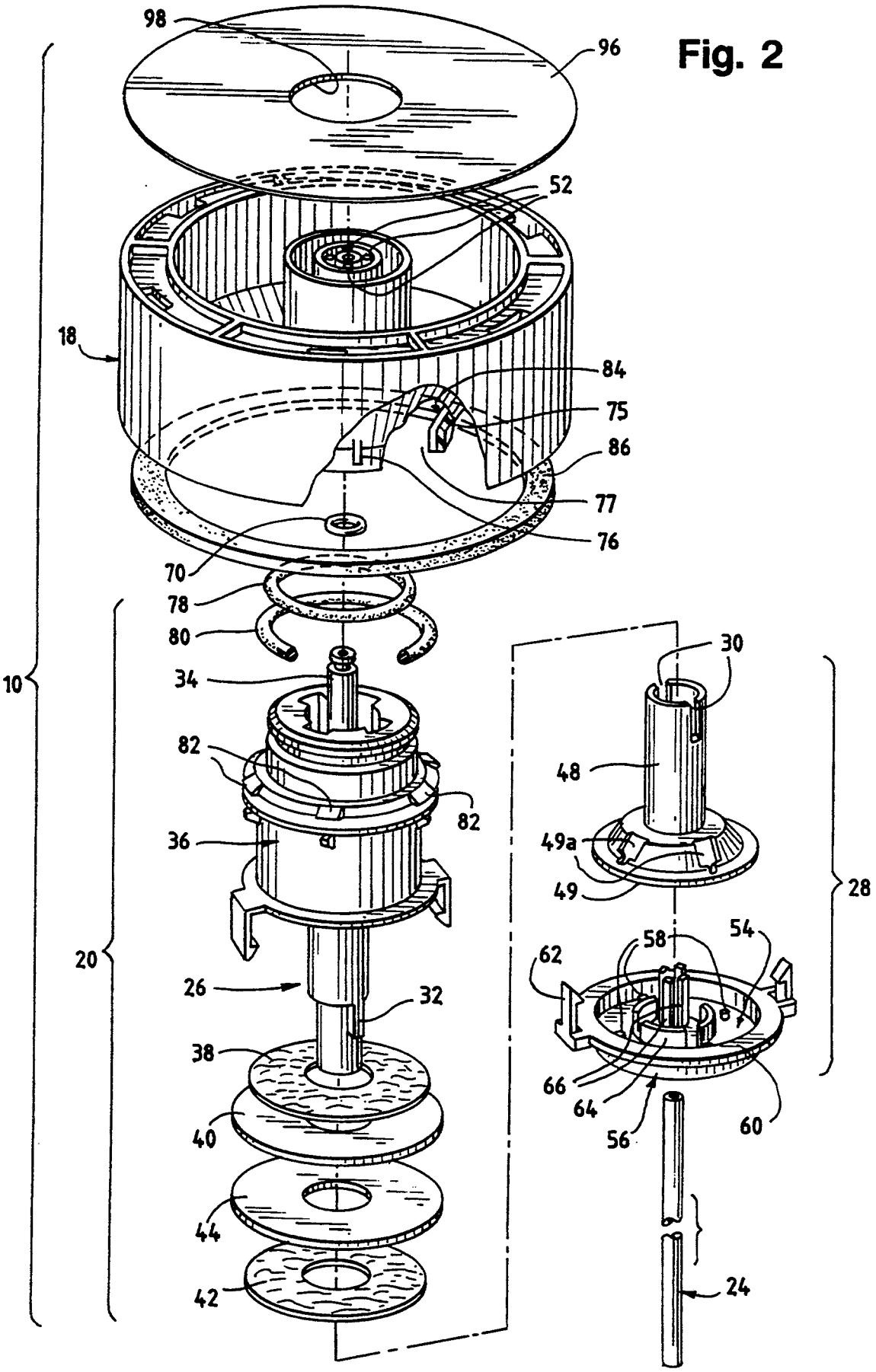
FIG. 2 is an exploded view of the container shown in FIG. 2 (from which the container housing is omitted)

As best shown in FIGS. 2 and 3, the top surface of the cap structure 18 is formed by a metallic foil wall 96 which also serves as the upper enclosing wall of the reservoir chamber 22 as best shown in FIG. 3, so that thermal expansion of the diluent D can be resiliently absorbed by flexibility of the metallic wall 96. Any damage to the foil wall 96 also serves to evidence tampering. The foil wall 96 has a central aperture 98 so that the centrally arranged vent discharge ports 52 are not obstructed.

Figure 6:
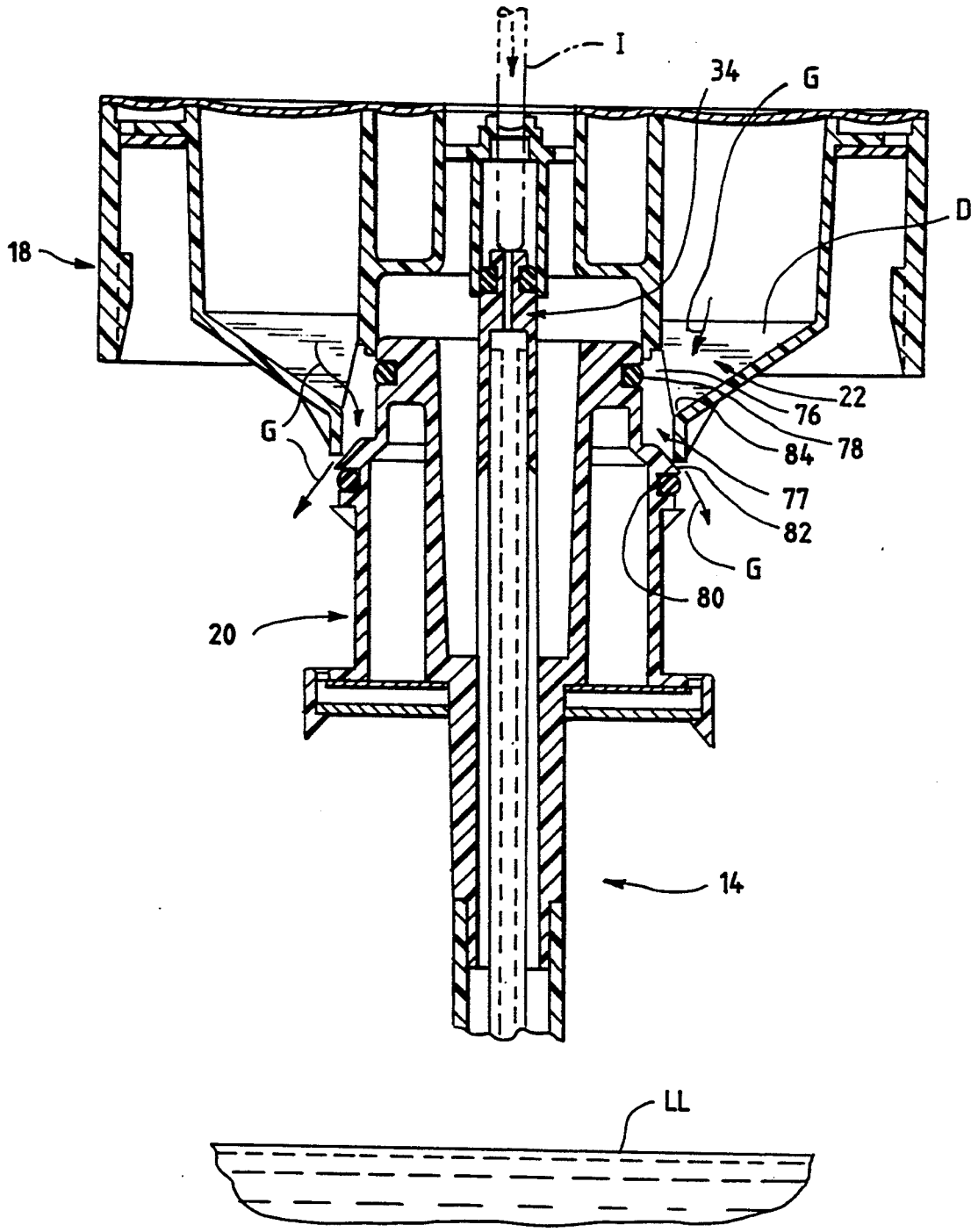
FIG. 6 is a fragmentary sectional view similar to FIG. 3 in which the sealing structure shown in FIG. 4 has been disengaged to open the bottom of the diluent reservoir to drainage internal to the container.

Referring now to FIG. 6, when the supply of liquid L has been substantially exhausted, a small amount of residual liquid LL can remain in the bottom of the container 10, representing potential hazard while in full strength for example concentrated hydrogen peroxide. Accordingly, the aforementioned intermixture of diluent D from reservoir chamber 22 into the residual liquid LO is achieved by lowering the cam member I of the aforementioned liquid feed system, against the end of the inner dip tube support cylinder 34 with sufficient force to downwardly displace and break away the entire dip tube/vent tube assembly 20 and overcome the interference resistance of the catch hooks 82 with disengagement from the shoulder seat 84 (FIG. 4). This break away produces disengagement of the seal by the O-ring 78 and 80 from the respective reservoir walls and opens the clearance spaces 77 between the bridge member 76 to allow drainage therethrough of the diluent D into the cavity 14 and diluting intermixture with the residual liquid LO (along the path indicated by directional arrows G). The intermixture of the diluent D and residual liquid LO will be non-hazardous so that the spent container 10 can be disposed with general refuse. For example, residual concentrated hydrogen peroxide can be diluted with water as the diluent D whereby the intermixture is designed to produce a harmless concentration of hydrogen peroxide of approximately 3 percent or less.

While an embodiment of the present invention is shown and described, it is envisioned that those skilled in the art may devise various modifications without departing from the spirit and scope of the appended claims.

The invention is claimed as follows:

1. A container for storing and dispensing fluid, comprising: a housing having a primary fluid storage cavity for primary fluid therein; a movable member within said housing; a reservoir chamber formed within said housing and normally isolating a second fluid within said chamber from said cavity and contact with said primary fluid, said chamber and said movable member including cooperating detent structure for interference coupling and maintenance of a seal therebetween and enabling selective movement and uncoupling of said movable member to relieve said seal and to form a pathway at said uncoupling for flow communication from said chamber into said cavity allowing intermixture of said primary fluid and secondary fluid.

2. A container according to claim 1, wherein said movable member comprises a displaceable wall formed within said housing.

3. A container according to claim 1, wherein said reservoir chamber comprises an annular opening and said movable member comprises a displaceable annular wall selectively closing said annular opening.

4. A container according to claim 3, wherein said detent structure comprises a catch structure in removable snap engagement against a seat structure respectively formed on one of said annular chamber opening and annular closing wall.

5. A container for storing and dispensing fluid, comprising: a housing having a primary fluid storage cavity for primary fluid therein; a movable member within said housing; a reservoir chamber formed within said housing and normally isolating a second fluid within said chamber from said cavity and contact with said primary fluid, said chamber and said movable member including cooperating detent structure for interference coupling and maintenance of a seal therebetween and enabling selective movement and uncoupling of said movable member to relieve said seal and to form a pathway at said uncoupling for flow communication from said chamber into said cavity allowing intermixture of said primary fluid and secondary fluid, wherein said reservoir chamber comprises an annular opening and said movable member comprises a displaceable annular wall selectively closing said annular opening and said detent structure comprises a shoulder formed on said chamber opening in removable snap engagement against a hook formation on said closing wall.

6. A container according to claim 1, wherein said housing includes an opening mouth and a cap structure closing said mouth, said cap structure including said reservoir chamber unitarily molded therein.

7. A container according to claim 6, wherein said movable member comprises a tubular conduit extending from and displaceable with respect to said cap, said detent structure comprising a catch structure peripherally formed on said tubular conduit and a seat structure engaged by said catch structure and formed on said reservoir chamber.

8. A container according to claim 7, wherein said conduit comprises vent structure in fluid communication with said primary fluid storage cavity and opening through said housing to enable discharge of gas or vapor therefrom.

9. A container according to claim 8, wherein said vent structure comprises separated, upper and lower vent valves to enable vapor discharge through said conduit in variable orientations of said container.

10. A container according to claim 1, wherein said reservoir chamber includes at least one metallic foil wall.

11. A container according to claim 6, wherein said reservoir chamber includes at least one metallic foil wall which forms an upper wall of said cap.

12. A container for storing and dispensing fluid, comprising: a housing having a primary fluid storage cavity for primary fluid therein; and a reservoir chamber formed within said housing and normally isolating a second fluid within said chamber from said cavity and contact with said primary fluid, said reservoir chamber including at least one metallic foil wall, wherein said housing includes an opening mouth and a cap closing said opening mouth, said reservoir chamber being mounted on said cap and said foil wall forming an exteriorly exposed upper wall of said cap.

* * * * *